US011839948B2

(12) United States Patent
Yamazaki et al.

(10) Patent No.: US 11,839,948 B2
(45) Date of Patent: Dec. 12, 2023

(54) POLISHING APPARATUS

(71) Applicant: EBARA CORPORATION, Tokyo (JP)

(72) Inventors: Takashi Yamazaki, Tokyo (JP); Itsuki Kobata, Tokyo (JP); Ryuichi Kosuge, Tokyo (JP); Tadakazu Sone, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 888 days.

(21) Appl. No.: 16/692,092

(22) Filed: Nov. 22, 2019

(65) Prior Publication Data

US 2020/0171621 A1 Jun. 4, 2020

(30) Foreign Application Priority Data

Nov. 30, 2018 (JP) ..... 2018-225355

(51) Int. Cl.

| | |
|---|---|
| ***B24B 57/02*** | (2006.01) |
| ***B24B 37/34*** | (2012.01) |
| ***B24B 37/005*** | (2012.01) |
| ***B24B 37/10*** | (2012.01) |

(52) U.S. Cl.

CPC ..... *B24B 57/02* (2013.01); *B24B 37/005* (2013.01); *B24B 37/10* (2013.01); *B24B 37/34* (2013.01)

(58) Field of Classification Search

None

See application file for complete search history.

(56) References Cited

U.S. PATENT DOCUMENTS

| | | | | |
|---|---|---|---|---|
| 6,139,406 | A * | 10/2000 | Kennedy | B24B 37/04 451/283 |
| 6,283,840 | B1 * | 9/2001 | Huey | B24B 57/02 451/288 |
| 6,561,440 | B1 | 5/2003 | Hofherr | |
| 6,607,428 | B2 * | 8/2003 | Tolles | B24B 37/24 451/286 |
| 6,722,943 | B2 * | 4/2004 | Joslyn | B24B 37/04 451/60 |

(Continued)

FOREIGN PATENT DOCUMENTS

| | | | | |
|---|---|---|---|---|
| CN | 108177089 A * | 6/2018 | ..... | B24B 57/02 |
| EP | 1095734 A1 * | 5/2001 | ..... | B24B 37/04 |

(Continued)

OTHER PUBLICATIONS

Machine Generated English Translation of Description of CN 1-8177089A. Published Jun. 2018, (Year: 2018).*

(Continued)

*Primary Examiner* — Sylvia MacArthur

(74) *Attorney, Agent, or Firm* — BakerHostetler

(57) ABSTRACT

A polishing apparatus capable of increasing an added value is disclosed. The polishing apparatus includes a polishing table configured to support a polishing pad, a top ring configured to press a substrate against the polishing pad, and a liquid supply mechanism configured to supply a liquid onto the polishing pad. The liquid supply mechanism includes a nozzle arm configured to be movable in a radial direction of the polishing table, and a liquid ejection nozzle attached to the nozzle arm. The liquid ejection nozzle is a fan-shaped nozzle having a liquid throttle surface having a tapered shape.

10 Claims, 15 Drawing Sheets

(56) References Cited

U.S. PATENT DOCUMENTS

| | | | | |
|---|---|---|---|---|
| 7,108,588 | B1 * | 9/2006 | Guthrie | B24B 57/02 451/60 |
| 7,674,156 | B2 * | 3/2010 | Son | B24B 55/00 451/72 |
| 8,020,570 | B2 * | 9/2011 | Kishimoto | H01L 21/6708 156/345.55 |
| 8,366,872 | B2 * | 2/2013 | Tsutsumi | H01L 21/67745 216/87 |
| 9,623,434 | B2 * | 4/2017 | Amano | G03F 7/3021 |
| 10,500,694 | B2 * | 12/2019 | Bajaj | B24B 37/044 |
| 2003/0089800 | A1 * | 5/2003 | Hofherr | B05B 1/3447 239/472 |
| 2003/0199229 | A1 * | 10/2003 | Vereen | B24B 37/04 451/36 |
| 2016/0144478 | A1 * | 5/2016 | Kosuge | B24B 37/34 156/345.12 |
| 2018/0009078 | A1 | 1/2018 | Park | |
| 2018/0286699 | A1 * | 10/2018 | Lin | B24B 37/044 |
| 2018/0290263 | A1 * | 10/2018 | Sotozaki | B24B 37/042 |
| 2019/0314951 | A1 * | 10/2019 | Xu | H01L 21/67051 |
| 2020/0039029 | A1 * | 2/2020 | Sotozaki | B24B 37/107 |
| 2020/0039031 | A1 * | 2/2020 | Chen | B24B 57/02 |
| 2020/0171621 | A1 * | 6/2020 | Yamazaki | B24B 37/10 |

FOREIGN PATENT DOCUMENTS

| | | | | | |
|---|---|---|---|---|---|
| JP | H11-070464 | A | | 3/1999 | |
| JP | 2001-269868 | A | | 10/2001 | |
| JP | 2003-071720 | A | | 3/2003 | |
| JP | 2003-220554 | A | | 8/2003 | |
| JP | 2005-508741 | A | | 4/2005 | |
| JP | 2006-147773 | A | | 6/2006 | |
| JP | 2007-118130 | A | | 5/2007 | |
| JP | 2009-002901 | A | | 1/2009 | |
| JP | 2009-034809 | A | | 2/2009 | |
| JP | 2011-530422 | A | | 12/2011 | |
| JP | 2014-151381 | A | | 8/2014 | |
| JP | 2018098452 | A | * | 6/2018 | B08B 3/00 |
| KR | 20150047096 | A | * | 5/2015 | |
| WO | WO 2010/019264 | A2 | | 2/2010 | |

OTHER PUBLICATIONS

Machine Generated English Translation of Claims of CN 1-8177089A. Published Jun. 2018, (Year: 2018).*

Machine Generated English Translation of JP 2018098452 published Jun. 2018. (Year: 2018).*

Singapore Patent Application No. 10201911048S; Written Opinion and Search Report; dated Jun. 16, 2022; 9 pages.

* cited by examiner

POLISHING APPARATUS

CROSS REFERENCE TO RELATED APPLICATION

This document claims priority to Japanese Patent Application Number 2018-225355 filed Nov. 30, 2018, the entire contents of which are hereby incorporated by reference.

BACKGROUND

In a manufacturing process of semiconductor devices, a planarization technique of a surface of the semiconductor device is becoming more important. The most important technique in this planarization technique is chemical mechanical polishing (i.e., CMP). This chemical mechanical polishing (hereinafter, which is referred to as CMP) is a process of polishing a substrate, such as a wafer, by placing the substrate in sliding contact with a polishing surface while supplying a polishing liquid (slurry) containing abrasive grains, such as silica ($SiO_2$) or ceria ($CeO_2$) onto a polishing pad by using the polishing apparatus.

It is important to stabilize a polishing process of the substrate and increase an added value of the polishing apparatus. In particular, the polishing process of the substrate can be stabilized by continuing to supply the polishing liquid accurately to an appropriate area on the polishing pad and further by controlling a supply amount of polishing liquid. As a result, the added value of the polishing apparatus can be improved.

In order to increase the added value of the polishing apparatus, a reduction of consumables is required. In particular, since the polishing liquid is a relatively expensive consumable, it is required to reduce an amount of polishing liquid to be used. On the other hand, a spout position, a spout range, and a supply amount of polishing liquid greatly affect a removal rate (polishing rate) of the substrate of the substrate. Therefore, in order to avoid a decrease in the removal rate of the substrate, it is necessary to appropriately manage the spout position, the spout range, and the supply amount of polishing liquid.

SUMMARY OF THE INVENTION

According to an embodiment, there is provided a polishing apparatus capable of increasing an added value.

Embodiments, which will be described below, relate to a polishing apparatus for polishing a substrate such as a wafer.

In an embodiment, there is provided a polishing apparatus, comprising: a polishing table configured to support a polishing pad; a top ring configured to press a substrate against the polishing pad; and a liquid supply mechanism configured to supply a liquid onto the polishing pad, the liquid supply mechanism comprises: a nozzle arm configured to be movable in a radial direction of the polishing table; and a liquid ejection nozzle attached to the nozzle arm, the liquid ejection nozzle being a fan-shaped nozzle having a liquid throttle surface, the liquid throttle surface being formed on an inner surface of the liquid ejection nozzle and having a tapered shape.

In an embodiment, the liquid supply mechanism comprises a slurry nozzle attached to the nozzle arm; the slurry nozzle is disposed above a center of the polishing pad when the nozzle arm is in a processing position; and the liquid ejection nozzle is disposed at a region between the center of the polishing pad and an outer peripheral portion of the polishing pad when the nozzle arm is in the processing position.

In an embodiment, the liquid supply mechanism comprises a nozzle cleaning device disposed outside the polishing pad, and the nozzle cleaning device comprises: a first cleaning nozzle configured to clean the slurry nozzle; and a second cleaning nozzle configured to clean the liquid ejection nozzle.

In an embodiment, the liquid supply mechanism comprises: a slurry line coupled to the liquid ejection nozzle and flowing a polishing liquid; a flushing line coupled to the liquid ejection nozzle and flowing a flushing liquid for cleaning the liquid ejection nozzle.

In an embodiment, the polishing apparatus, further comprising an atomizer configured to eject a cleaning fluid onto the polishing pad, the liquid supply mechanism comprises a dressing liquid supply device attached to the atomizer.

In an embodiment, the liquid supply mechanism comprises a slurry nozzle attached to the nozzle arm; and the slurry nozzle and the liquid ejection nozzle are disposed above a center of the polishing pad when the nozzle arm is in a processing position.

In an embodiment, A polishing apparatus, comprising: a polishing table configured to support a polishing pad; a top ring configured to press a substrate against the polishing pad; and a liquid supply mechanism configured to supply a liquid onto the polishing pad, the liquid supply mechanism comprises a nozzle abnormality detection device configured to detect an abnormality of a liquid ejection nozzle attached to a nozzle arm, the nozzle arm being movable in a radial direction of the polishing table, and the nozzle abnormality detection device determines the abnormality of the liquid ejection nozzle based on a degree of opening of a flow-rate adjustment valve, the flow-rate adjustment valve being configured to adjust a size of a flow path of a liquid supply line coupled to the liquid ejection nozzle.

In an embodiment, the nozzle abnormality detection device is configured to: determine an abnormal clogging of the liquid ejection nozzle under a condition that the degree of opening of the flow-rate adjustment valve reaches a predetermined upper-limit-side threshold value; and determine an abnormal wear of the liquid ejection nozzle under a condition that the degree of opening of the flow-rate adjustment valve reaches a predetermined lower-limit-side threshold value.

In an embodiment, the upper-limit-side threshold value has a first upper-limit-side threshold value and a second upper-limit-side threshold value larger than the first upper-limit-side threshold value; and the nozzle abnormality detection device is configured to issue one of a minor failure alarm for recommending an exchange of the liquid ejection nozzle and a major failure alarm for stopping an operation of the polishing apparatus based on the first upper-limit-side threshold value and the second upper-limit-side threshold value.

In an embodiment, the lower-limit-side threshold value has a first lower-limit-side threshold value and a second lower-limit-side threshold value lower than the first lower-limit-side threshold value; and the nozzle abnormality detection device is configured to issue one of a minor failure alarm for recommending an exchange of the liquid ejection nozzle and a major failure alarm for stopping an operation of the polishing apparatus based on the first lower-limit-side threshold value and the second lower-limit-side threshold value.

The liquid ejection nozzle which is a fan-shaped nozzle can eject a small amount of polishing liquid over a wide range. Therefore, the polishing apparatus can reduce the amount of polishing liquid to be used and improve the removal rate (polishing rate) of the substrate. As a result, the polishing apparatus can improve the added value of the polishing apparatus.

The nozzle abnormality detection device can determine an abnormality of the liquid ejection nozzle. Therefore, the polishing apparatus can appropriately manage the spout position, the spout range, and the supply amount of polishing liquid. As a result, the polishing apparatus can improve the added value of the polishing apparatus.

DESCRIPTION OF EMBODIMENTS

Figure 1:
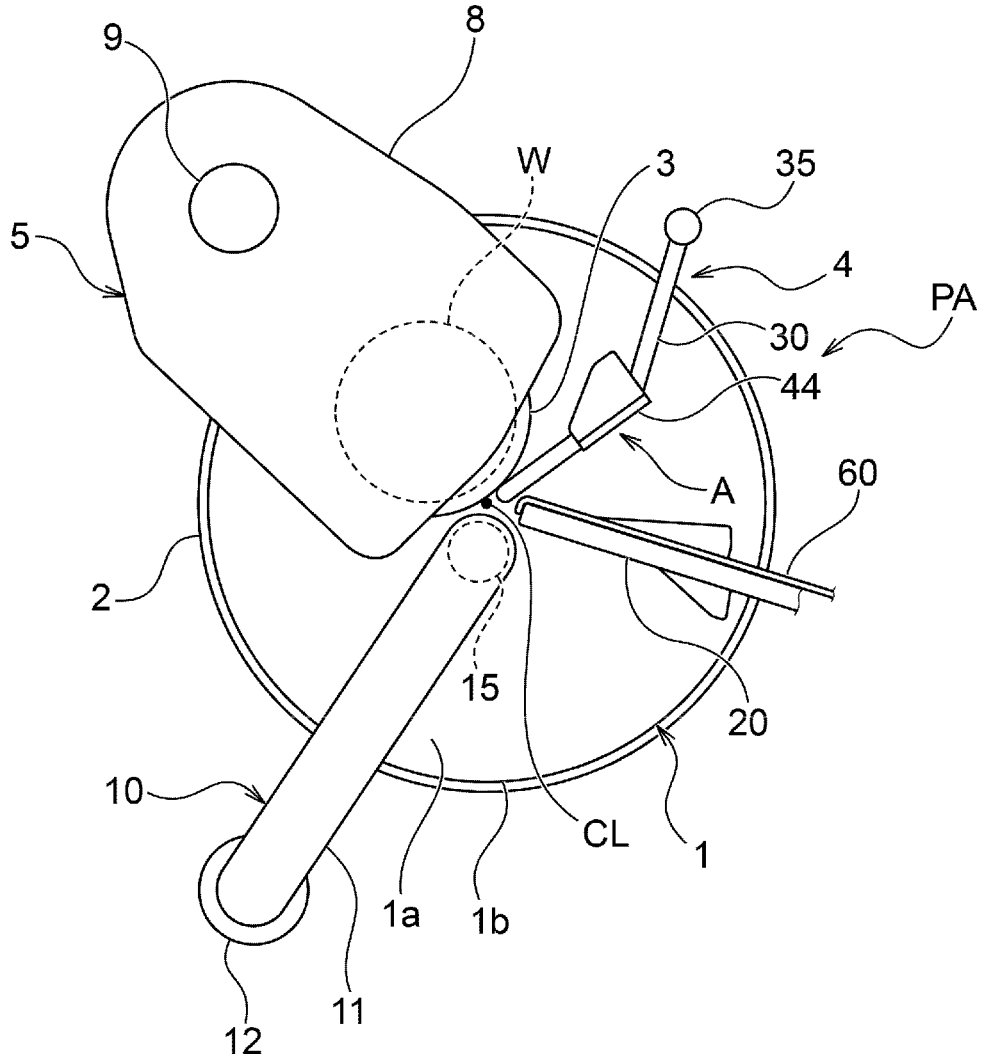
FIG. 1 is a plan view of an embodiment of a polishing apparatus.

Embodiments will be described below with reference to the drawings. In the drawings described below, identical or corresponding components will be denoted by identical reference numerals, and repetitive descriptions thereof are omitted.

FIG. 1 is a plan view of an embodiment of a polishing apparatus PA. As shown in FIG. 1, the polishing apparatus PA includes a polishing table 2 for supporting a polishing pad 1, a top ring 3 for pressing a substrate W, such as a wafer, against the polishing pad 1, and a liquid supply mechanism 4 for supplying the liquid onto the polishing pad 1. The liquid supplied from the liquid supply mechanism 4 onto the polishing pad 1 is a polishing liquid (slurry) or pure water (DIW).

The polishing table 2 is coupled to a table motor (not shown) for rotating the polishing table 2 via a table shaft (not shown) for supporting the polishing table 2. The polishing pad 1 is attached to an upper surface of the polishing table 2, and the upper surface of the polishing pad 1 constitutes a polishing surface 1*a* for polishing the substrate W.

The top ring 3 is coupled to a lower end of a top ring shaft (not shown). The top ring 3 is configured to hold the substrate W on its lower surface by vacuum suction. The top ring shaft is coupled to a rotating mechanism (not shown) which is provided in a top ring arm 8. The top ring 3 is rotated via the top ring shaft by the rotating mechanism.

The top ring arm 8 is coupled to a top ring pivot shaft 9 which pivots the top ring arm 8. The top ring pivot shaft 9 is disposed outside the polishing pad 1. The top ring 3, the top ring arm 8, and the top ring pivot shaft 9 constitute a top ring device 5.

The polishing apparatus PA further includes a dressing device 10 for dressing the polishing pad 1. The dressing device 10 includes a dresser 15 which is brought into sliding contact with the polishing surface 1*a* of the polishing pad 1, a dresser arm 11 for supporting the dresser 15, and a dresser pivot shaft 12 which pivots the dresser arm 11. The dresser pivot shaft 12 is disposed outside the polishing pad 1.

When the dresser arm 11 pivots, the dresser 15 oscillates on the polishing surface 1*a*. The dresser 15 has a lower surface serving as a dressing surface constituted by a number of abrasive grains, such as diamond particles. While oscillating on the polishing surface 1*a*, the dresser 15 rotates on the polishing surface 1*a* to scrape away the polishing pad 1 slightly, thereby dressing the polishing surface 1*a*. During dressing of the polishing pad 1, the liquid supply mechanism 4 (more specifically, a dressing liquid supply device 60) supplies pure water onto the polishing surface 1*a* of the polishing pad 1. Details of configurations of the liquid supply mechanism 4 will be described later.

The polishing apparatus PA further includes an atomizer 20 for cleaning the polishing surface 1*a* by ejecting an atomized cleaning fluid onto the polishing surface 1*a* of the polishing pad 1. The cleaning fluid is composed of a fluid mixture of a liquid (typically pure water) and a gas (e.g., an inert gas such as nitrogen gas). The atomizer 20 extends in a radial direction of the polishing pad 1 (or the polishing table 2), and is located above the polishing surface 1*a* of the polishing pad 1. The atomizer 20 is configured to deliver a jet of the high-pressure cleaning fluid onto the polishing surface 1*a* to thereby remove polishing debris and the abrasive grains, contained in the polishing liquid, from the polishing surface 1*a* of the polishing pad 1.

Figure 2A:
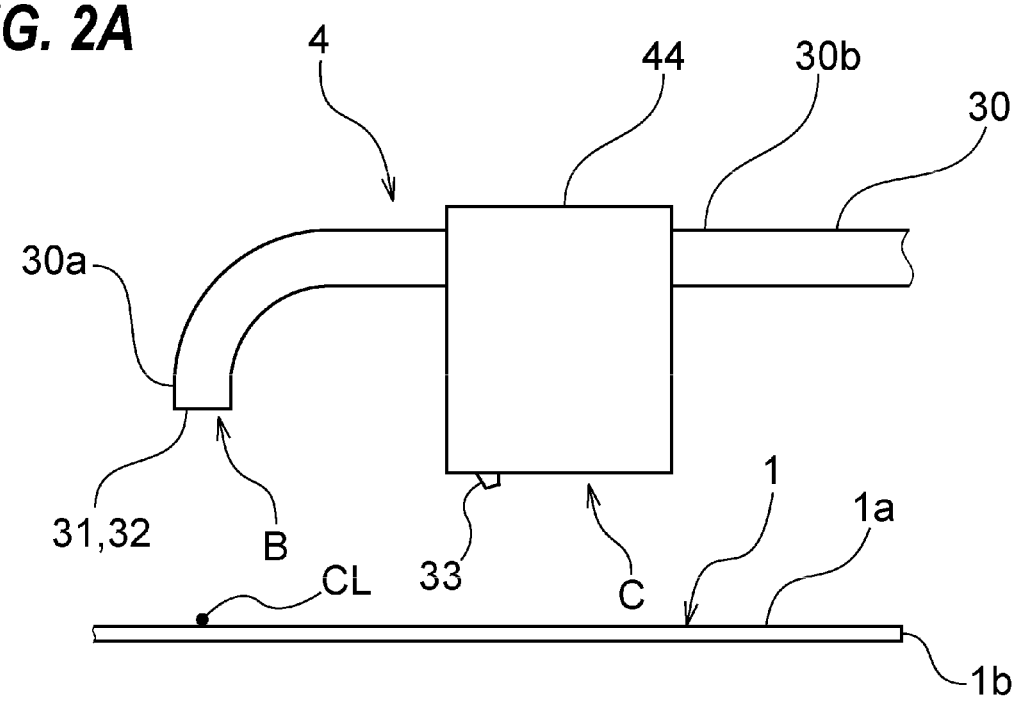
FIG. 2A is a view from a direction indicated by arrow A in FIG. 1.
Figure 2B:
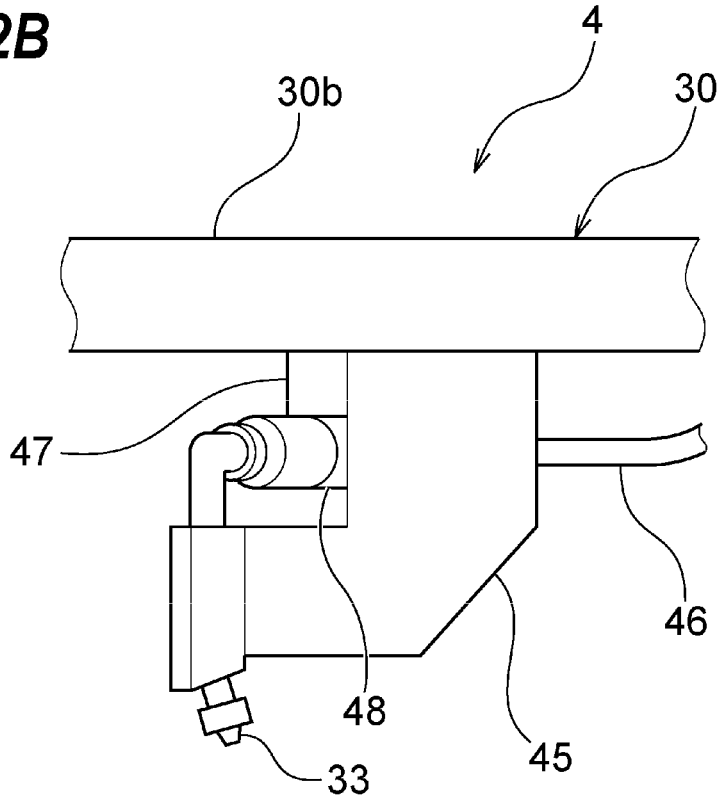
FIG. 2B is a view showing a state in which a contamination prevention cover in FIG. 2A is removed.

Hereinafter, configurations of the liquid supply mechanism 4 will be described with reference to the drawings. FIG. 2A is a view from a direction indicated by arrow A in FIG. 1. FIG. 2B is a view showing a state in which a contamination prevention cover in FIG. 2A is removed.

The liquid supply mechanism 4 includes a nozzle arm 30 which is movable in the radial direction of the polishing table 2, a first slurry nozzle 31 and a second slurry nozzle 32 which are disposed at a tip portion 30*a* of the nozzle arm 30, and a liquid ejection nozzle 33 which is disposed to an arm portion 30*b* of the nozzle arm 30.

The nozzle arm 30 is coupled to a nozzle pivot shaft 35 which pivots the nozzle arm 30 (see FIG. 1). The nozzle pivot shaft 35 is disposed outside the polishing pad 1. The nozzle arm 30 is configured to be movable between a retracted position outside the polishing pad 1 and a processing position above the polishing pad 1 by driving the nozzle pivot shaft 35 (more specifically, a motor which is coupled to the nozzle pivot shaft 35).

As shown in FIG. 2A, when the nozzle arm 30 is in the processing position, the tip portion 30*a* of the nozzle arm 30 is located above a center CL of the polishing pad 1. Therefore, the first slurry nozzle 31 and the second slurry nozzle 32 located at the tip portion 30*a* of the nozzle arm 30 are located above the center CL of the polishing pad 1 such that an ejection port of the first slurry nozzle 31 and an ejection port of the second slurry nozzle 32 face the center CL of the polishing pad 1.

When the nozzle arm 30 is in the processing position, the liquid ejection nozzle 33 is located above a region between the center CL of the polishing pad 1 and an outer peripheral portion 1*b* of the polishing pad 1 so that the ejection port of the liquid ejection nozzle 33 faces the region.

In one embodiment, the liquid ejection nozzle 33 is made of resin. Examples of a material of the liquid ejection nozzle 33 include PTFE (polytetrafluoroethylene), polyvinyl chloride (PVC), or polypropylene (PP).

The liquid ejection nozzle 33 supplies a slurry A, the first slurry nozzle 31 supplies a slurry B, and the second slurry nozzle 32 supplies a slurry C. The slurry A, the slurry B, and the slurry C are different types of liquids.

Figure 3A:
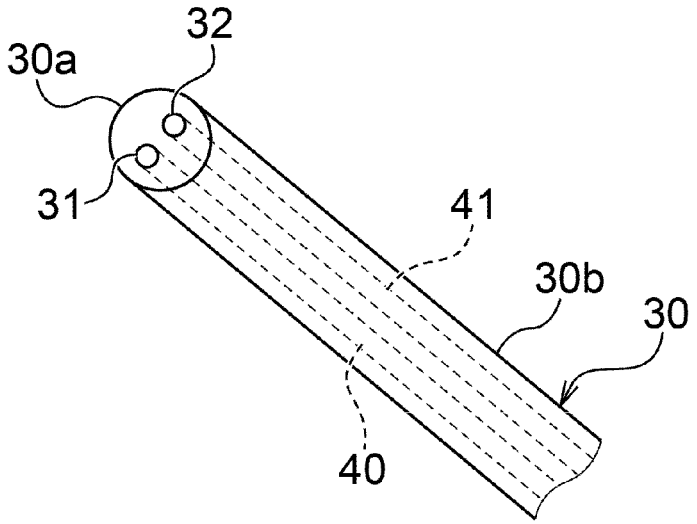
FIG. 3A is a view from a direction indicated by arrow B in FIG. 2A.
Figure 3B:
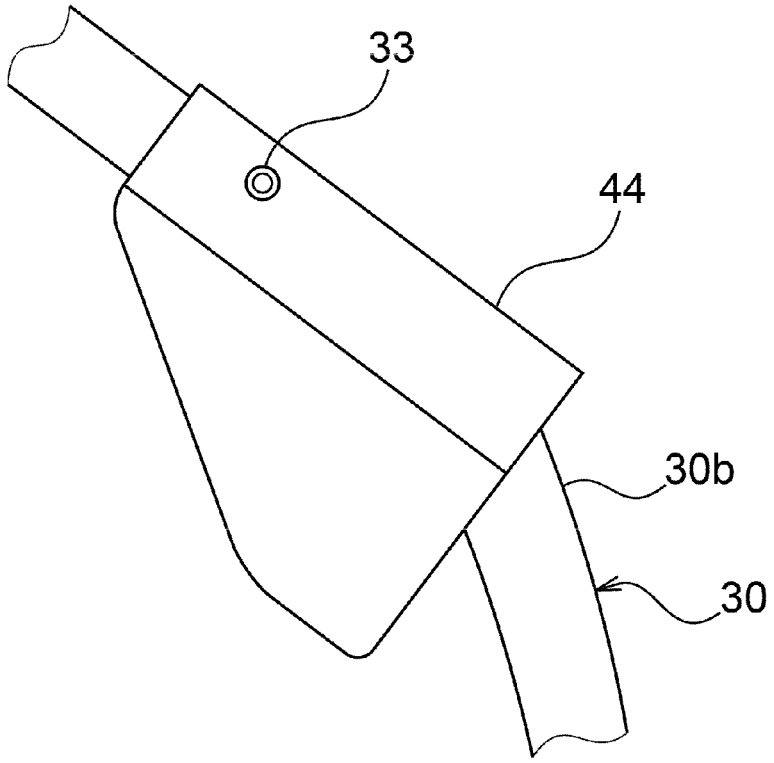
FIG. 3B is a view from a direction indicated by arrow C in FIG. 2A.

FIG. 3A is a view from a direction indicated by arrow B in FIG. 2A. FIG. 3B is a view from a direction indicated by arrow C in FIG. 2A. As shown in FIG. 3A, the first slurry nozzle (first liquid nozzle) 31 and the second slurry nozzle (second liquid nozzle) 32 are disposed adjacent to each other. The first slurry nozzle 31 is connected to a first slurry line (first liquid supply line) 40 in which a flow path is formed. The slurry B flows through the flow path. The second slurry nozzle 32 is connected to the second slurry line (second liquid supply line) 41 in which a flow path is formed. The slurry C flows through the flow path. The first slurry line 40 and the second slurry line 41 are disposed inside the nozzle arm 30.

As shown in FIG. 2B, the liquid ejection nozzle 33 is attached to a nozzle holder 45 which extends downward from the nozzle arm 30. The nozzle holder 45 is fixed to the nozzle arm 30. In this embodiment, as shown in FIG. 2A, the nozzle holder 45 is covered with a contamination prevention cover 44. As a result, adherence of foreign matter to the nozzle holder 45 and a coupling member 48 is prevented.

As shown in FIG. 2A, the liquid ejection nozzle 33 is disposed closer to the polishing surface 1*a* of the polishing pad 1 than the first slurry nozzle 31 and the second slurry nozzle 32. In other words, a distance between the polishing surface 1*a* of the polishing pad 1 and the liquid ejection nozzle 33 is smaller than a distance between the polishing surface 1*a* of the polishing pad 1 and the first slurry nozzle 31 and the second slurry nozzle 32.

The liquid ejection nozzle 33 is inclined toward the outer peripheral portion 1*b* side of the polishing pad 1 (i.e., the direction away from the center CL of the polishing pad 1) with respect to a vertical direction. In one embodiment, an angle of inclination of the liquid ejection nozzle 33 is 13 degrees.

Figure 4:
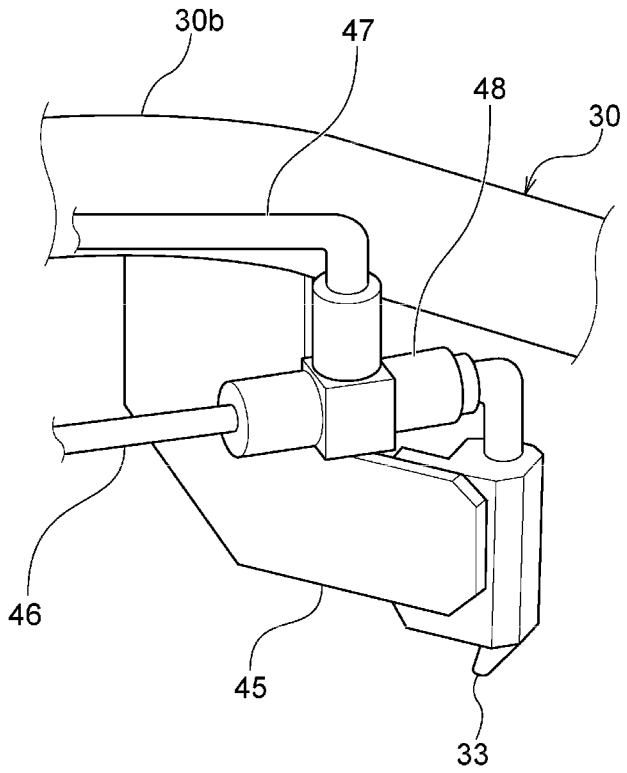
FIG. 4 is a view showing a third slurry line and a flushing line which are coupled to a liquid ejection nozzle.

FIG. 4 is a view showing a third slurry line (third liquid supply line) 46 and a flushing line 47 which are coupled to the liquid ejection nozzle 33. As shown in FIG. 4, the liquid ejection nozzle 33 is connected to the third slurry line 46 in which a flow path is formed. The slurry A flows through the flow path. The coupling member 48 is connected to an intermediate portion of the third slurry line 46. The flushing line 47 to which a flow path is formed is connected to the coupling member 48. Pure water flows through the flow path. The coupling member 48 is provided at a junction between the flushing line 47 and the third slurry line 46.

Hereinafter, in this specification, an upstream side of the coupling member 48 may be referred to as an upstream flow path of the third slurry line 46 in a flow direction of the slurry A. A downstream side of the coupling member 48 may be referred to as a downstream flow path of the third slurry line 46 in the flow direction.

The coupling member 48 is disposed adjacent to the liquid ejection nozzle 33. Pure water flowing through the flushing line 47 and a tip portion of the third slurry line 46 (in other words, downstream flow path of the third slurry line 46) is ejected from the liquid ejection nozzle 33. The liquid (slurry A or pure water) flowing through one of the third slurry line 46 and flushing line 47 is ejected from the liquid ejection nozzle 33.

Pure water flowing through the flushing line 47 passes through the tip portion of the third slurry line 46 and the liquid ejection nozzle 33 and is ejected to the outside. Pure water is a flushing liquid for cleaning the tip portion of the third slurry line 46 and the liquid ejection nozzle 33. Pure water as the flushing liquid flows vigorously in the liquid ejection nozzle 33 to thereby instantaneously remove the slurry retained in the tip portion of the third slurry line 46 and the liquid ejection nozzle 33. As a result, fixing of the slurry in the tip portion of the third slurry line 46 and the liquid ejection nozzle 33 is prevented.

The coupling member 48 is disposed adjacent to the liquid ejection nozzle 33 which is in a position which is closer to a slurry spout position. With such an arrangement, the polishing apparatus PA can minimize an amount of exchanging the slurry with pure water (i.e., slurry exchange amount), and can maintain a throughput (the number of processed substrates W) of the polishing apparatus PA.

Figure 5:
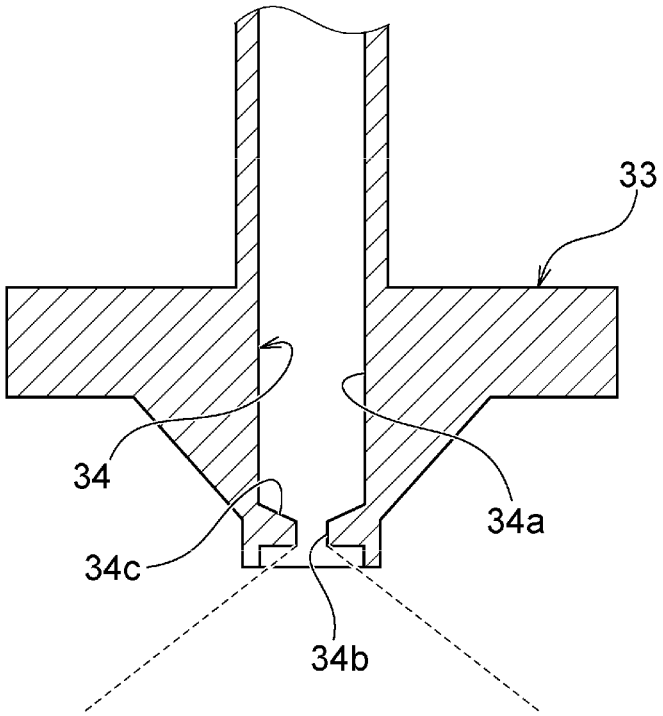
FIG. 5 is a cross-sectional view showing the liquid ejection nozzle.

FIG. 5 is a cross-sectional view showing the liquid ejection nozzle 33. As shown in FIG. 5, the liquid ejection nozzle 33 is a fan-shaped nozzle which ejects fanwise the liquid. The liquid ejection nozzle 33 has a liquid passage surface 34*a*, a liquid ejection surface 34*b*, and a liquid throttle surface 34*c* which are formed on an inner surface 34 of the liquid ejection nozzle 33.

The liquid throttle surface 34*c* is disposed between the liquid passage surface 34*a* and the liquid ejection surface 34*b*. The liquid throttle surface 34*c* is connected to the liquid passage surface 34*a* and the liquid ejection surface 34*b*, and has a tapered shape. More specifically, the liquid throttle surface 34*c* has a shape in which an inner diameter of the liquid ejection nozzle 33 gradually decreases from the liquid passage surface 34*a* toward the liquid ejection surface 34*b*.

When the liquid ejection nozzle 33 is the fan-shaped nozzle, there is a possibility that the slurry containing minute abrasive grains is fixed inside the liquid ejection nozzle 33. In this embodiment, the liquid ejection nozzle 33 has the liquid throttle surface 34*c* formed on the inner surface 34 of the liquid ejection nozzle 33 and having a tapered shape. Therefore, the slurry inside the liquid ejection nozzle 33 flows smoothly on the liquid throttle surface 34*c* without retaining on the liquid throttle surface 34*c*. In this manner, the retaining of the slurry inside the liquid ejection nozzle 33 is prevented. As a result, fixing of the slurry inside the liquid ejection nozzle 33 is prevented.

Figure 6:
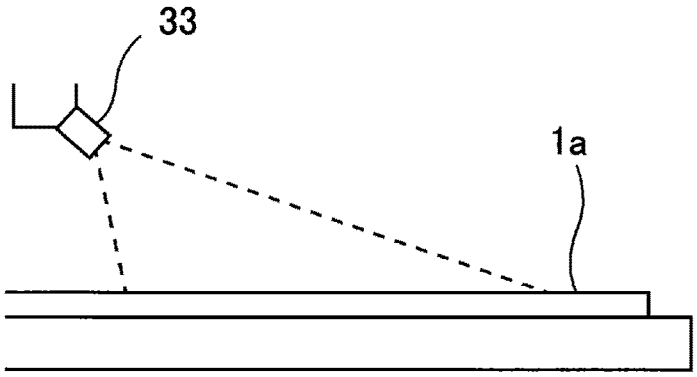
FIG. 6 is a view showing a spout range of the slurry.

FIG. 6 is a view showing the spout range of the slurry A. As shown in FIG. 6, in this embodiment, the slurry A ejected from the liquid ejection nozzle 33 is supplied fanwise onto the polishing surface 1*a* of the polishing pad 1. The slurry A is ejected into a region including the center CL of the polishing pad 1 and inside the outer peripheral portion 1*b* of the polishing pad 1. In one embodiment, an angle of ejection (in other words, an angle of the slurry A ejected from the liquid ejection nozzle 33) of the liquid ejection nozzle 33 is in a range of 50 degrees to 150 degrees.

According to this embodiment, the liquid ejection nozzle 33 can eject a small amount of slurry over a wide range. Therefore, the amount of slurry to be used can be reduced, and the removal rate (polishing rate) of the substrate with respect to the amount of slurry to be used can be improved.

Figure 7:
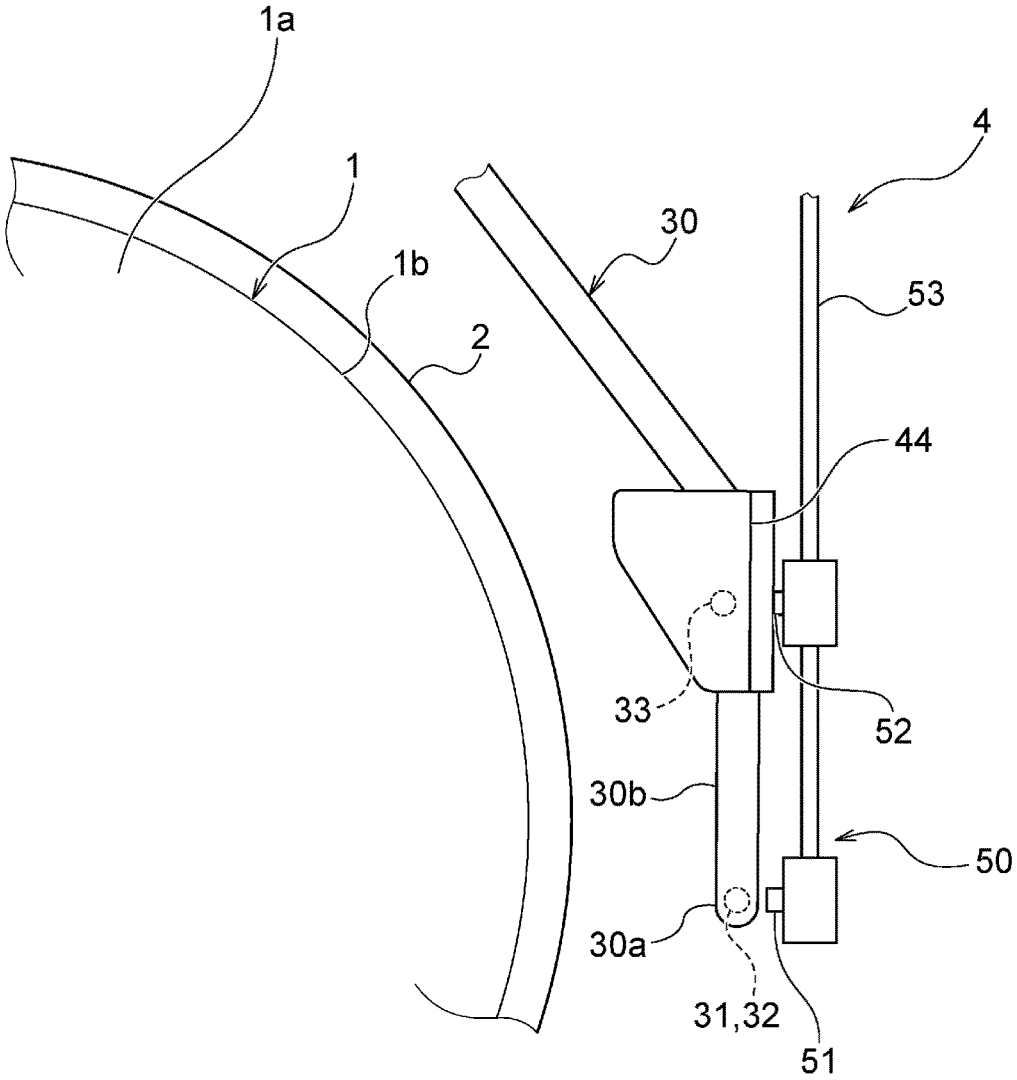
FIG. 7 is a view showing a nozzle cleaning device.
Figure 8A:
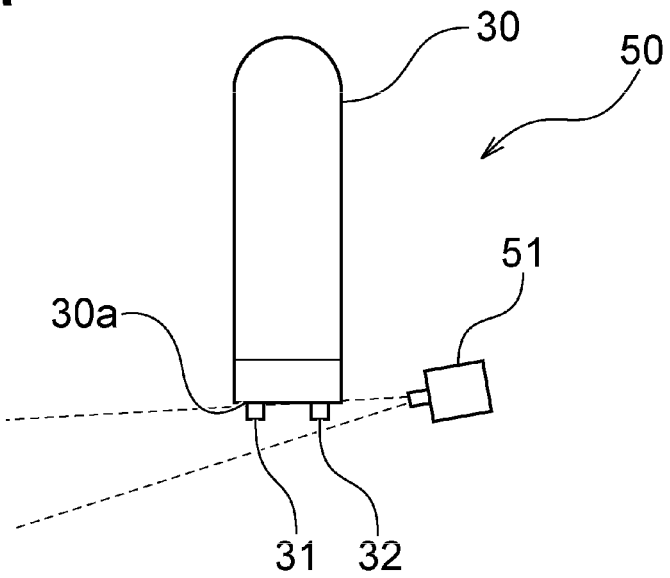
FIG. 8A is a view showing a first cleaning nozzle of the nozzle cleaning device.
Figure 8B:
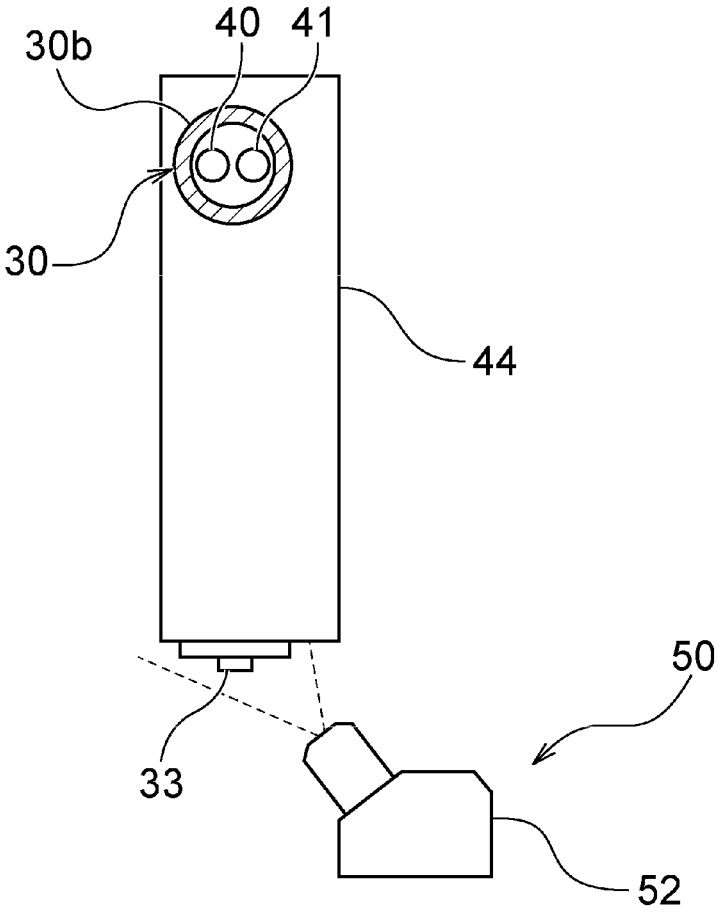
FIG. 8B is a view showing a second cleaning nozzle of the nozzle cleaning device.

FIG. 7 is a view showing a nozzle cleaning device 50. FIG. 8A is a view showing a first cleaning nozzle 51 of the nozzle cleaning device 50. FIG. 8B is a view showing a second cleaning nozzle 52 of the nozzle cleaning device 50. The liquid supply mechanism 4 includes the nozzle cleaning device 50 for cleaning nozzles (i.e., the first slurry nozzle 31, the second slurry nozzle 32, and the liquid ejection nozzle 33) attached to the nozzle arm 30.

The nozzle cleaning device 50 includes the first cleaning nozzle 51 for cleaning the first slurry nozzle 31 and the second slurry nozzle 32 attached to the tip portion 30*a* of the nozzle arm 30, the second cleaning nozzle 52 for cleaning the liquid ejection nozzle 33 attached to the arm portion 30*b* of the nozzle arm 30, and a cleaning line 53 to which the first cleaning nozzle 51 and the second cleaning nozzle 52 are coupled.

As shown in FIG. 7, the nozzle cleaning device 50 is disposed outside the polishing pad 1. When the nozzle arm 30 is moved to the retracted position, the nozzle arm 30 is adjacent to the nozzle cleaning device 50. More specifically, when the nozzle arm 30 is in the retracted position, the first cleaning nozzle 51 faces the first slurry nozzle 31 and the second slurry nozzle 32, and the second cleaning nozzle 52 faces the liquid ejection nozzle 33.

Each of the first cleaning nozzle 51 and the second cleaning nozzle 52 is a fan-shaped nozzle. Pure water is ejected fanwise from the first cleaning nozzle 51 toward the first slurry nozzle 31 and the second slurry nozzle 32. Similarly, pure water is ejected fanwise from the second cleaning nozzle 52 toward the liquid ejection nozzle 33. In this manner, the first slurry nozzle 31, the second slurry nozzle 32, and the liquid ejection nozzle 33 are cleaned with pure water (cleaning liquid) flowing through the cleaning line 53.

As shown in FIG. 8A, an ejection port of the first cleaning nozzle 51 faces obliquely downward. The first cleaning nozzle 51 ejects pure water from obliquely upward to the first slurry nozzle 31 and the second slurry nozzle 32.

As shown in FIG. 8B, an ejection port of the second cleaning nozzle 52 faces obliquely upward. The second cleaning nozzle 52 ejects pure water from obliquely below to the liquid ejection nozzle 33. The second cleaning nozzle 52 is disposed below the liquid ejection nozzle 33. Therefore, the second cleaning nozzle 52 can reliably clean the liquid ejection nozzle 33, particularly the liquid ejection surface 34*b* of the liquid ejection nozzle 33 (see FIG. 5). As a result, fixing of the slurry on the liquid ejection surface 34*b* is prevented.

According to this embodiment, even when the first slurry nozzle 31, the second slurry nozzle 32, and the liquid ejection nozzle 33 are contaminated by the slurry ejected onto the polishing pad 1, the nozzle cleaning device 50 can clean the first slurry nozzle 31, the second slurry nozzle 32, and the liquid ejection nozzle 33.

Figure 9:
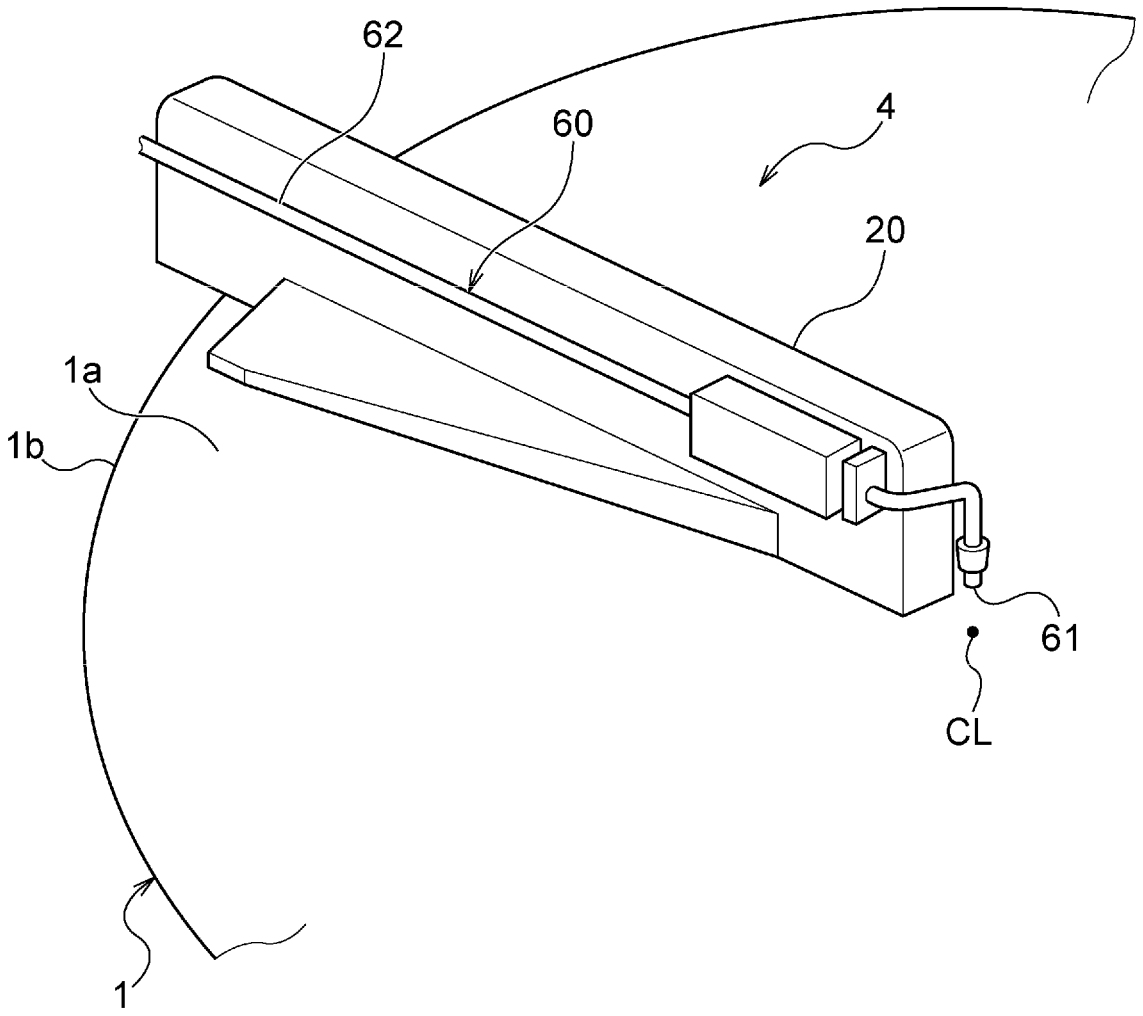
FIG. 9 is a view showing a dressing liquid supply device fixed to an atomizer.

FIG. 9 is a view showing a dressing liquid supply device 60 fixed to the atomizer 20. As shown in FIG. 9, the liquid supply mechanism 4 includes the dressing liquid supply device 60 fixed to the atomizer 20. Therefore, the atomizer 20 and the dressing liquid supply device 60 can be moved integrally. The dressing liquid supply device 60 supplies a dressing liquid (e.g., pure water) onto the polishing surface 1*a* of the polishing pad 1 during dressing of the polishing pad 1 by the dresser 15 (see FIG. 1).

The dressing liquid supply device 60 includes a dressing liquid supply nozzle 61 which is located above the center CL of the polishing pad 1 when the atomizer 20 is in the processing position above the polishing pad 1, and the dressing liquid supply line 62 to which the dressing liquid supply nozzle 61. The dressing liquid flows through the dressing liquid supply line 62, and is supplied from the dressing liquid supply nozzle 61 onto the center CL of the polishing pad 1.

When performing the dressing of the polishing pad 1, the nozzle arm 30 may be in the retracted position. In this embodiment, the atomizer 20 is disposed at the processing position above the polishing pad 1 when performing the dressing of the polishing pad 1. Therefore, the dressing liquid supply device 60 attached to the atomizer 20 is disposed at the processing position above the polishing pad 1 when performing the dressing of the polishing pad 1. With this configuration, even when the nozzle arm 30 is moved to the retracted position when performing the dressing of the polishing pad 1, the dressing device 10 can perform the dressing of the polishing pad 1 in the presence of the dressing liquid supplied from the dressing liquid supply device 60.

Figure 10:
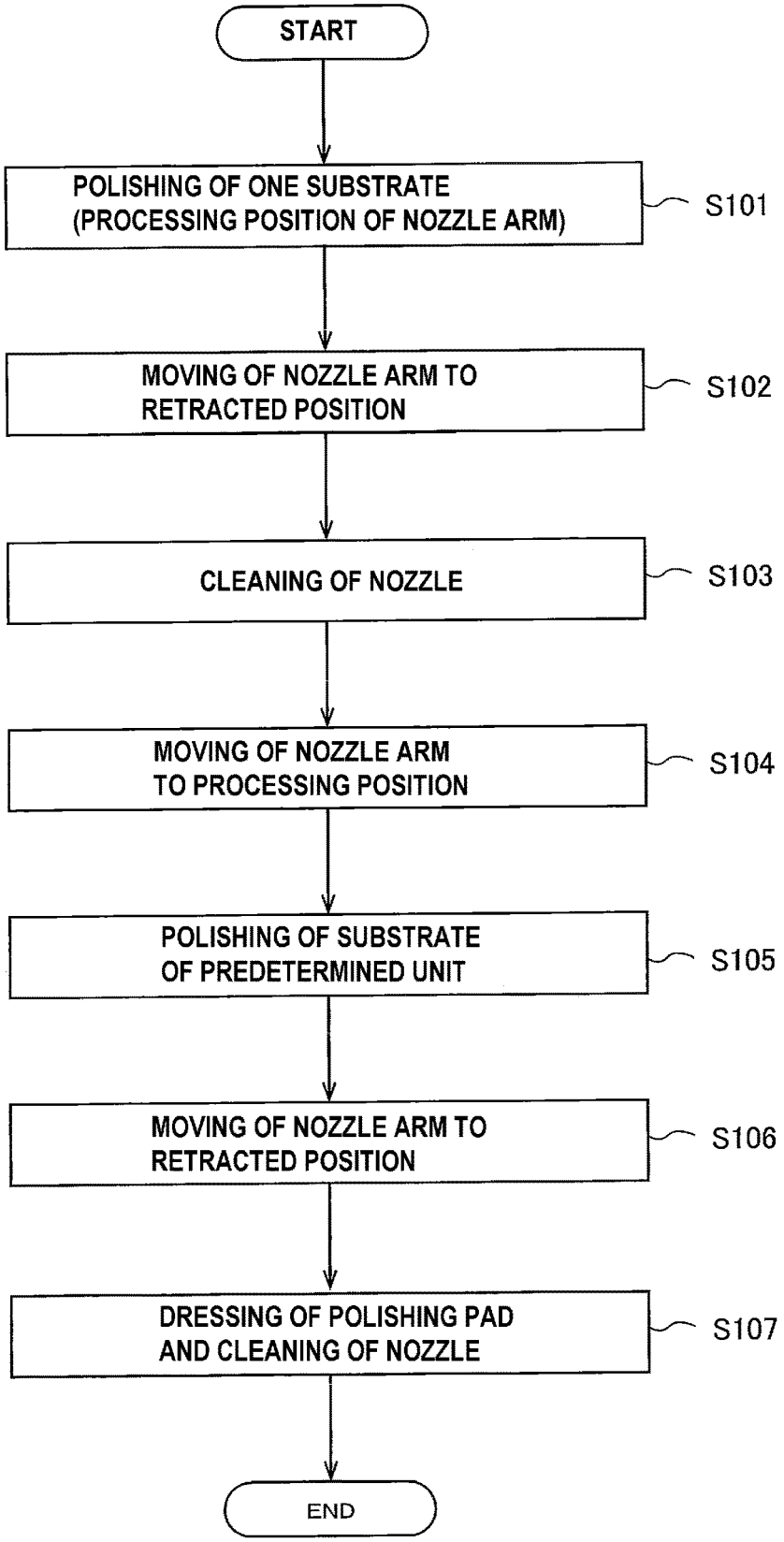
FIG. 10 is a flowchart showing processing steps of a substrate.

FIG. 10 is a flowchart showing processing steps of the substrate. The polishing apparatus PA starts the polishing of a transferred substrate W (see step S101). When polishing the substrate W, the nozzle arm 30 is disposed at the processing position above the polishing pad 1.

The nozzle arm 30 is moved to the retracted position outside the polishing pad 1 each time one substrate W is processed (see step S102). The first slurry nozzle 31, the second slurry nozzle 32, and the liquid ejection nozzle 33 are cleaned by the nozzle cleaning device 50 each time one substrate W is processed (see step S103). Therefore, the nozzle cleaning device 50 can improve a cleanliness of the first slurry nozzle 31, the second slurry nozzle 32, and the liquid ejection nozzle 33.

After a cleaning process by the nozzle cleaning device 50 is terminated, the nozzle arm 30 is moved again to the processing position (see step S104), and the polishing apparatus PA starts the polishing of the newly transported substrate. In this manner, the processing from step S101 to step S104 is repeated a plurality of times, and the substrate of a predetermined unit (the number of lots) is polished (see step S105).

Thereafter, the nozzle arm 30 is moved to the retracted position (see step S106). After step S106, the dressing device 10 performs the dressing of the polishing pad 1, and the nozzle cleaning device 50 performs the cleaning of the first slurry nozzle 31, the second slurry nozzle 32, and the liquid ejection nozzle 33 (see step S107).

Figure 11:
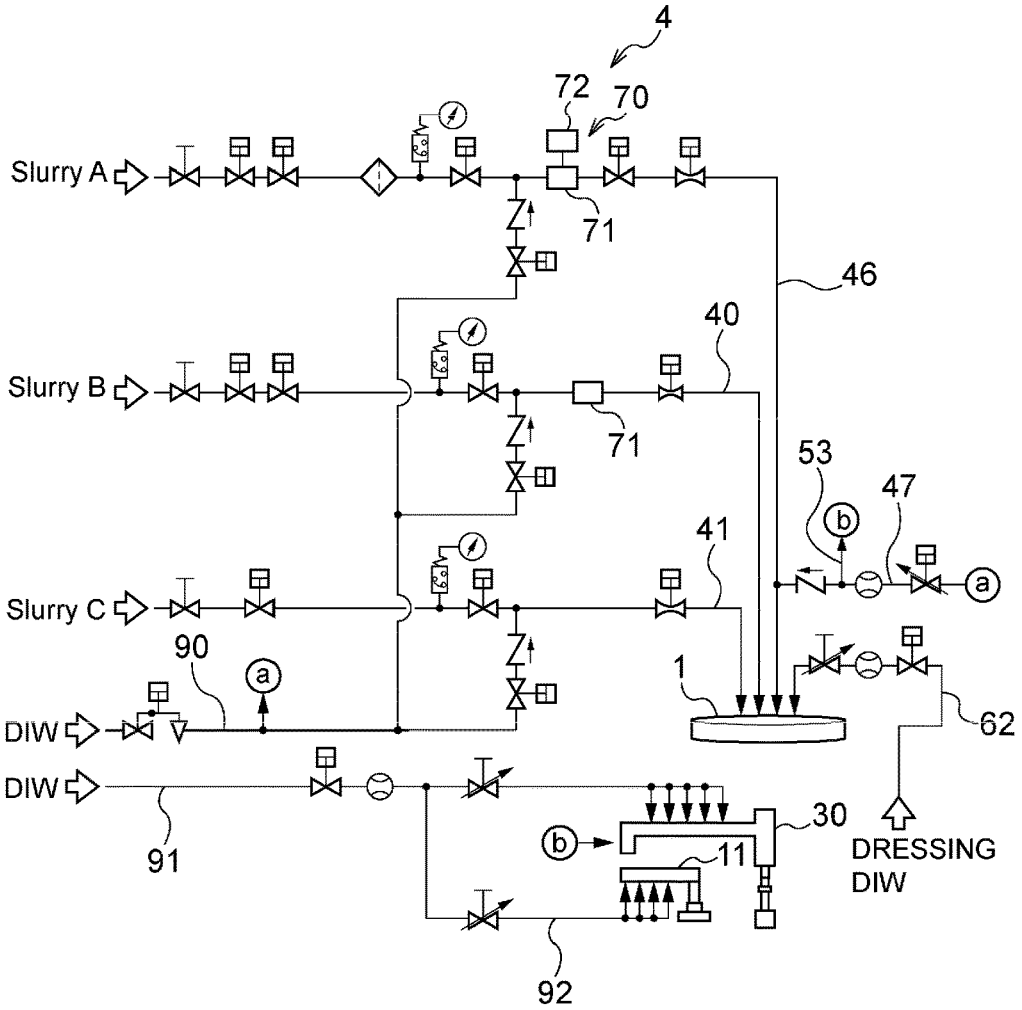
FIG. 11 is a schematic view showing a piping system of the polishing apparatus.

FIG. 11 is a schematic view showing a piping system of the polishing apparatus PA. As shown in FIG. 11, the polishing apparatus PA includes a pure water line 90 and a cleaning main line 91 in which flow paths are formed respectively. Pure water flows through each of the flow paths. The pure water line 90 and the cleaning main line 91 are separate lines.

The flushing line 47 (see FIG. 4) is connected to the pure water line 90. Pure water (i.e., flushing liquid) flowing through the pure water line 90 and the flushing line 47 is ejected from the liquid ejection nozzle 33. The cleaning line 53 (see FIG. 7) is connected to the flushing line 47. Pure water (i.e., cleaning liquid) flowing through the pure water line 90, the flushing line 47, and the cleaning line 53 is ejected from the first cleaning nozzle 51 and the second cleaning nozzle 52.

As shown in FIG. 11, a cleaning branch line 92 which branches from a middle of the cleaning main line 91 is connected to the cleaning main line 91. Pure water (i.e., cleaning liquid) flowing through the cleaning main line 91 cleans the nozzle arm 30. Pure water (i.e., cleaning liquid) flowing through the cleaning main line 91 and the cleaning branch line 92 cleans the dresser arm 11.

As shown in FIG. 11, the liquid supply mechanism 4 includes a nozzle abnormality detection device 70 which detects an abnormality of the liquid ejection nozzle 33. A flow rate (supply amount) of the slurry and/or an ejection range (spout position and spout range) of the slurry has a great influence on the removal rate of the substrate. Therefore, a management of the flow rate of the slurry and/or the ejection range of the slurry is important. Thus, the nozzle abnormality detection device 70 determines an abnormality of the liquid ejection nozzle 33 (more specifically, at least one of an abnormal clogging and an abnormal wear of the liquid ejection nozzle 33).

The nozzle abnormality detection device 70 includes a flow-rate controller 71 for controlling the flow rate of the slurry flowing through the third slurry line 46, and a determiner 72 for determining an abnormality of the liquid ejection nozzle 33 based on a signal sent from the flow-rate controller 71.

Figure 12:
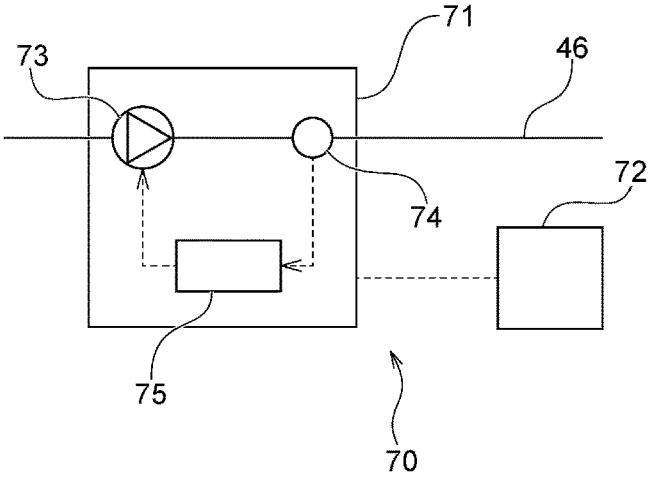
FIG. 12 is a view showing a nozzle abnormality detection device.

FIG. 12 is a view showing the nozzle abnormality detection device 70. As shown in FIG. 12, the flow-rate controller 71 and the determiner 72 are electrically connected to each other. The flow-rate controller 71 is a device for performing a closed loop control.

The flow-rate controller 71 includes a flow-rate adjustment valve 73 for adjusting a size of the flow path of the third slurry line 46, a flow sensor 74 for detecting the flow rate of the slurry flowing through the third slurry line 46, and a flow controller 75 for controlling a degree of opening of the flow-rate adjustment valve 73 based on the flow rate measured by the flow sensor 74.

Examples of the flow-rate adjustment valve 73 include a pinch valve. The flow sensor 74 is disposed on the downstream side of the flow-rate adjustment valve 73 in the flow direction of the slurry flowing through the third slurry line 46. The flow controller 75 is electrically connected to the flow-rate adjustment valve 73 and the flow sensor 74. The flow controller 75 controls the degree of opening of the flow-rate adjustment valve 73 so that the flow rate of the slurry flowing through the third slurry line 46 becomes a preset flow rate.

The degree of opening of the flow-rate adjustment valve 73 (more specifically, a signal indicating the degree of opening) is sent to the determiner 72. The determiner 72 determines the abnormality of the liquid ejection nozzle 33 based on the degree of opening of the flow-rate adjustment valve 73.

Figure 13:
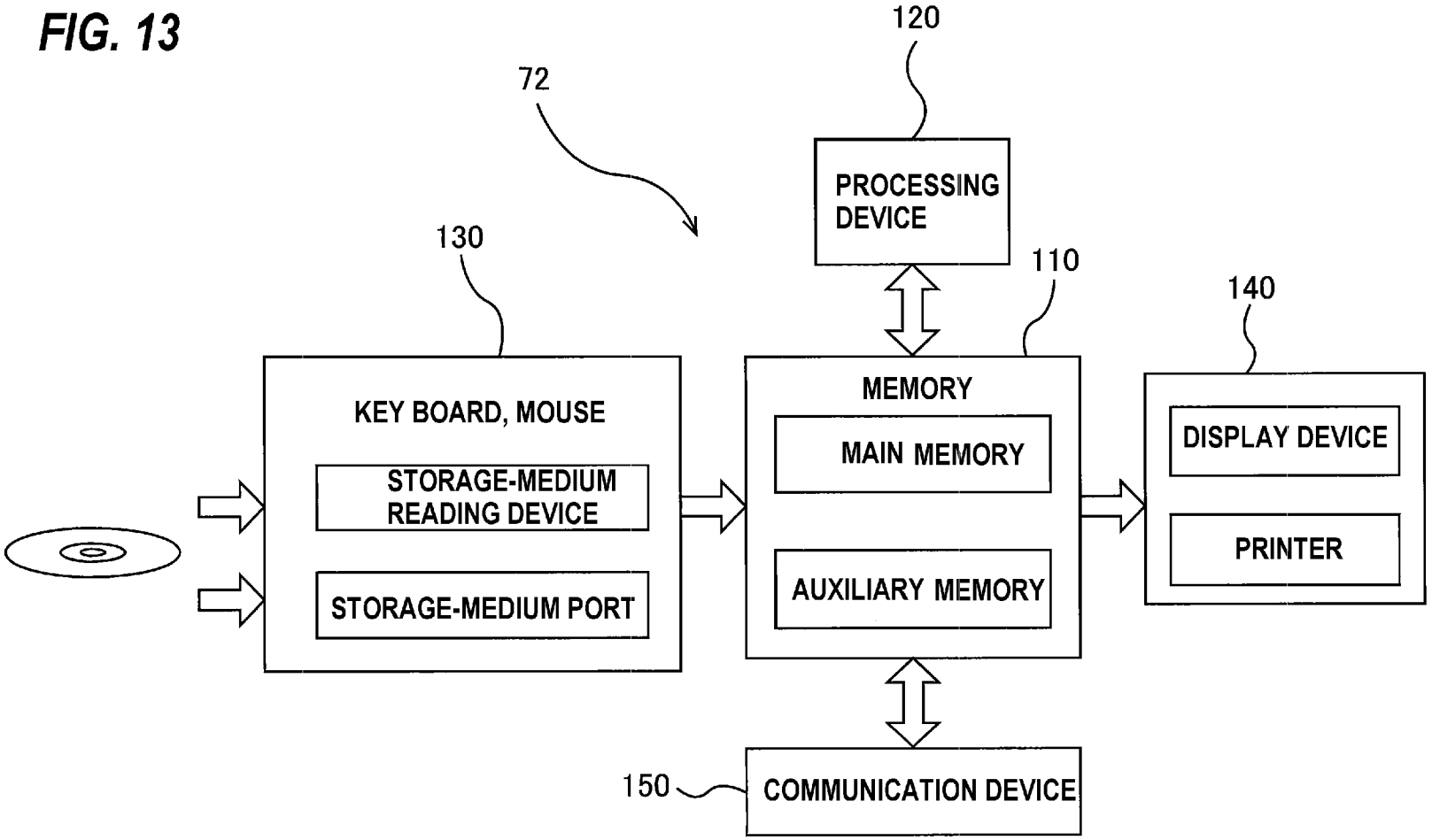
FIG. 13 is a view showing a configuration of a determiner.

FIG. 13 is a view showing a configuration of the determiner 72. As shown in FIG. 13, the determiner 72 is constituted by a dedicated computer or a general-purpose computer. The determiner 72 includes a memory 110 in which a program and data are stored, a processing device 120, such as CPU (central processing unit) or GPU (graphic processing unit), for performing arithmetic operation according to the program stored in the memory 110, an input device 130 for inputting the data, the program, and various information in the memory 110, an output device 140 for outputting processing results and processed data, and a communication device 150 for connecting to a network, such as the Internet.

The determiner 72 operates according to a program electrically stored in the memory 110. The program is stored in a non-transitory tangible computer-readable storage medium, and is then provided to the determiner 72 via the storage medium. The program may be provided to the determiner 72 via communication network, such as the Internet.

Figure 14:
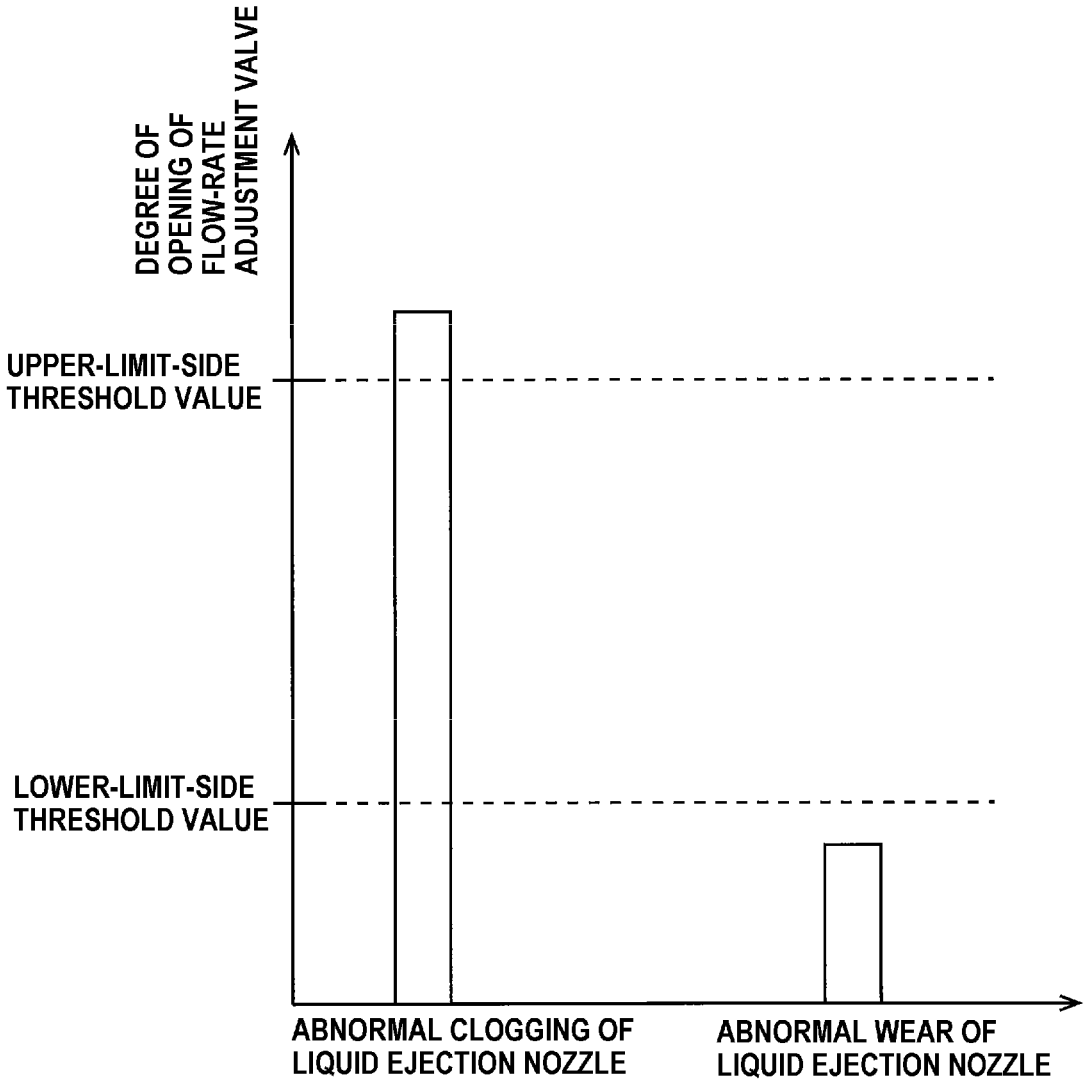
FIG. 14 is a view showing a state in which the determiner detects an abnormality of the liquid ejection nozzle.

FIG. 14 is a view showing a state in which the determiner 72 detects an abnormality of the liquid ejection nozzle 33. When the slurry is clogged in the liquid ejection nozzle 33, the flow rate of the liquid (slurry or pure water) flowing through the third slurry line 46 becomes small, and a pressure of the liquid is abnormally increased. The flow controller 75 increases the degree of opening of the flow-rate adjustment valve 73 so that the flow rate of the liquid is increased. When the degree of opening of the liquid adjustment valve 73 reaches a predetermined upper-limit-side threshold value, i.e., the degree of opening is equal to or higher than the upper-limit-side threshold value, the determiner 72 determines the abnormal clogging of the liquid ejection nozzle 33 and issues an abnormal signal.

When the liquid ejection nozzle 33 is worn by the slurry, the flow rate of the liquid (slurry or pure water) flowing through the third slurry line 46 is increased, and the pressure of the liquid is abnormally decreased. The flow controller 75 decreases the degree of opening of the flow-rate adjustment valve 73 so that the flow rate of the liquid becomes small. When the degree of opening of the flow-rate adjustment valve 73 reaches a predetermined lower-limit-side threshold value, i.e., when the degree of opening is decreased to the lower-limit-side threshold value, the determiner 72 determines an abnormal wear of the liquid ejection nozzle 33, and issues an abnormal signal.

In the embodiment shown in FIG. 14, the memory 110 stores a single upper-limit-side threshold value and a signal lower-limit-side threshold value. In one embodiment, the memory 110 may store a plurality of upper-limit-side threshold values and a plurality of lower-limit-side threshold values. For example, the upper-limit-side threshold value may include a first upper-limit-side threshold value for a minor failure and a second upper-limit-side threshold value for a major failure. The second upper-limit-side threshold value is larger than the first upper-limit-side threshold value.

Similarly, the lower-limit-side threshold value may include a first lower-limit-side threshold value for a minor failure and a second lower-limit-side threshold value for a major failure. The second lower-limit-side threshold value is lower than the first lower-limit-side threshold value.

Figure 15:
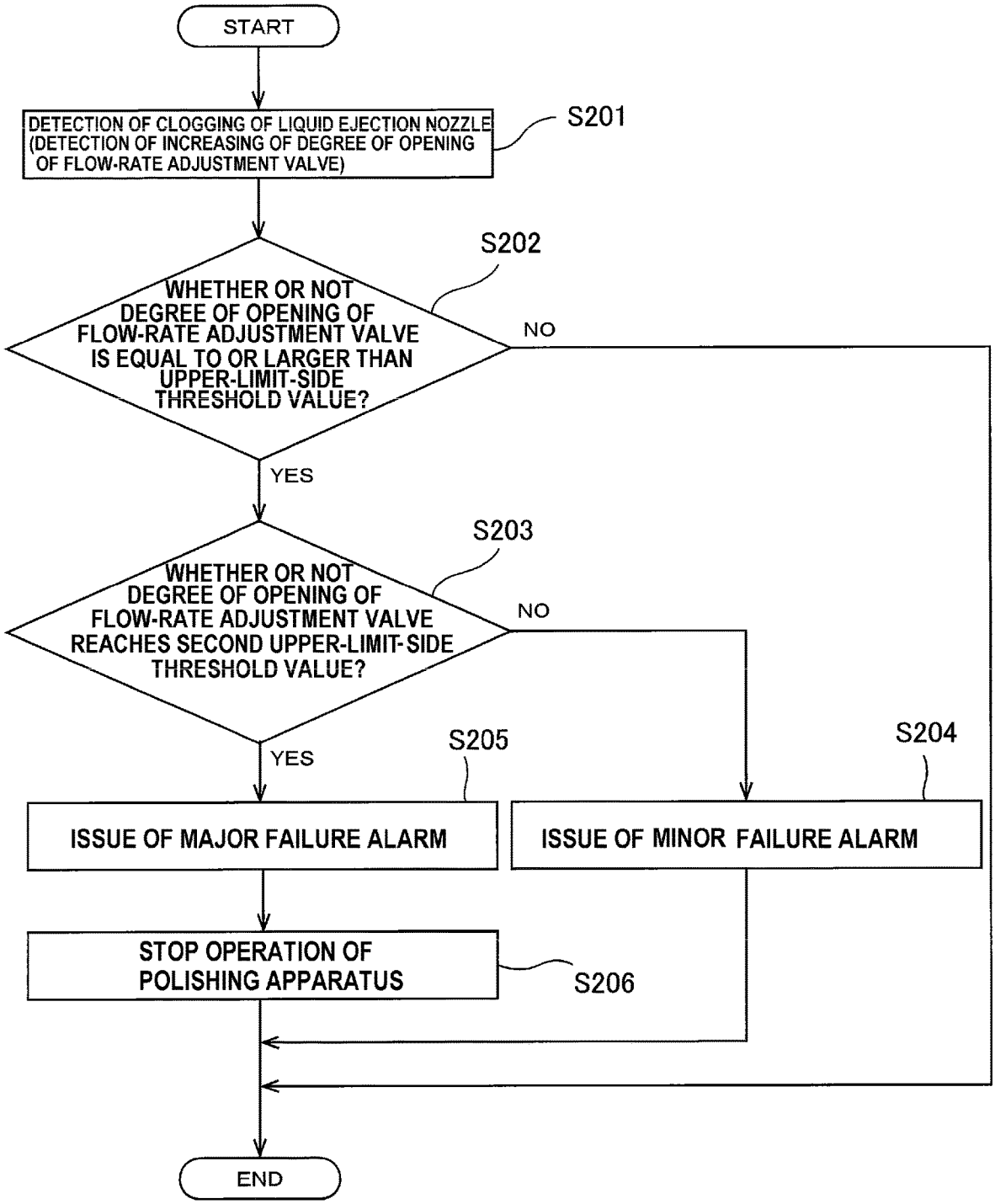
FIG. 15 is a view showing a flowchart for detecting the abnormality of the liquid ejection nozzle.

FIG. 15 is a view showing a flowchart for detecting the abnormality of the liquid ejection nozzle 33. The determiner 72 performs the steps shown in FIG. 15 according to an abnormality detection program of the liquid ejection nozzle 33. The abnormality detection program is electrically stored in the memory 110. In FIG. 15, a case where the liquid ejection nozzle 33 is clogged will be described as an example of the abnormality detection of the liquid ejection nozzle 33.

The determiner 72 constantly monitors the degree of opening the flow-rate adjustment valve 73 sent from the flow rate controller 71. As described above, when the slurry is clogged in the liquid ejection nozzle 33, the degree of opening of the flow-rate adjustment valve 73 is increased, and the determiner 72 detects the clogging of the liquid ejection nozzle 33 (see step S201).

After step S201, the determiner 72 determines whether or not the degree of opening of the flow-rate adjustment valve 73 is equal to or larger than the upper-limit-side threshold value (see step S202). When the determiner 72 determines that the degree of opening of the flow-rate adjustment valve 73 is lower than the upper-limit-side threshold value (see "NO" in step S202), the determiner 72 determines that the clogging of the liquid ejection nozzle 33 is not abnormal to terminate the abnormal detection program of the liquid ejection nozzle 33. In this case, an exchange of the liquid ejection nozzle 33 is not necessary.

When the determiner 72 determines that the degree of opening of the flow-rate adjustment value 73 is equal to or larger than the upper-limit-side threshold value (see "YES" in step S202), the determiner 72 determines that the clogging of the liquid ejection nozzle 33 is abnormal.

In the embodiment shown in FIG. 15, the memory 110 stores the upper-limit-side threshold value including the first upper-limit-side threshold value and the second upper-limit-side threshold value. As shown in step S203 in FIG. 15, the determiner 72 determines whether or not the degree of opening of the flow-rate adjustment valve 73 reaches the second upper-limit-side threshold value.

When the determiner 72 determines that the degree of opening of the flow-rate adjustment valve 73 does not reach the second upper-limit-side threshold value (see "NO" in step S203), the determiner 72 determines that the minor failure in the liquid ejection nozzle 33 occurs. In other words, the determiner 72 determines that the degree of opening of the flow-rate adjustment valve 73 is equal to or larger than the first upper-limit-side threshold value and lower than the second upper-limit-side threshold value.

In this case, the determiner 72 issues the minor failure alarm (see step S204). The minor failure alarm is an alarm for recommending the exchange of the liquid ejection nozzle 33. An operator may exchange the liquid ejection nozzle 33 based on the minor failure alarm.

When the determiner 72 determines that the degree of opening of the flow-rate adjustment valve 73 reaches the second upper-limit-side threshold value (see "YES" in step S203), the determiner 72 determines that the major failure in the liquid ejection nozzle 33 occurs to issue the major failure alarm (see step S205). The major failure alarm is an alarm for terminating the processing of the substrate W (process interlock). In this case, the determiner 72 stops the operation of the polishing apparatus PA (step S206) to terminate the abnormality detection program of the liquid ejection nozzle 33.

In the embodiment shown in FIG. 15, the embodiment in which the nozzle abnormality detection device 70 detects the clogging of the liquid ejection nozzle 33. The nozzle abnormality detection device 70 may detect the wear of the liquid ejection nozzle 33 through the same steps as those shown in FIG. 15.

Figure 16:
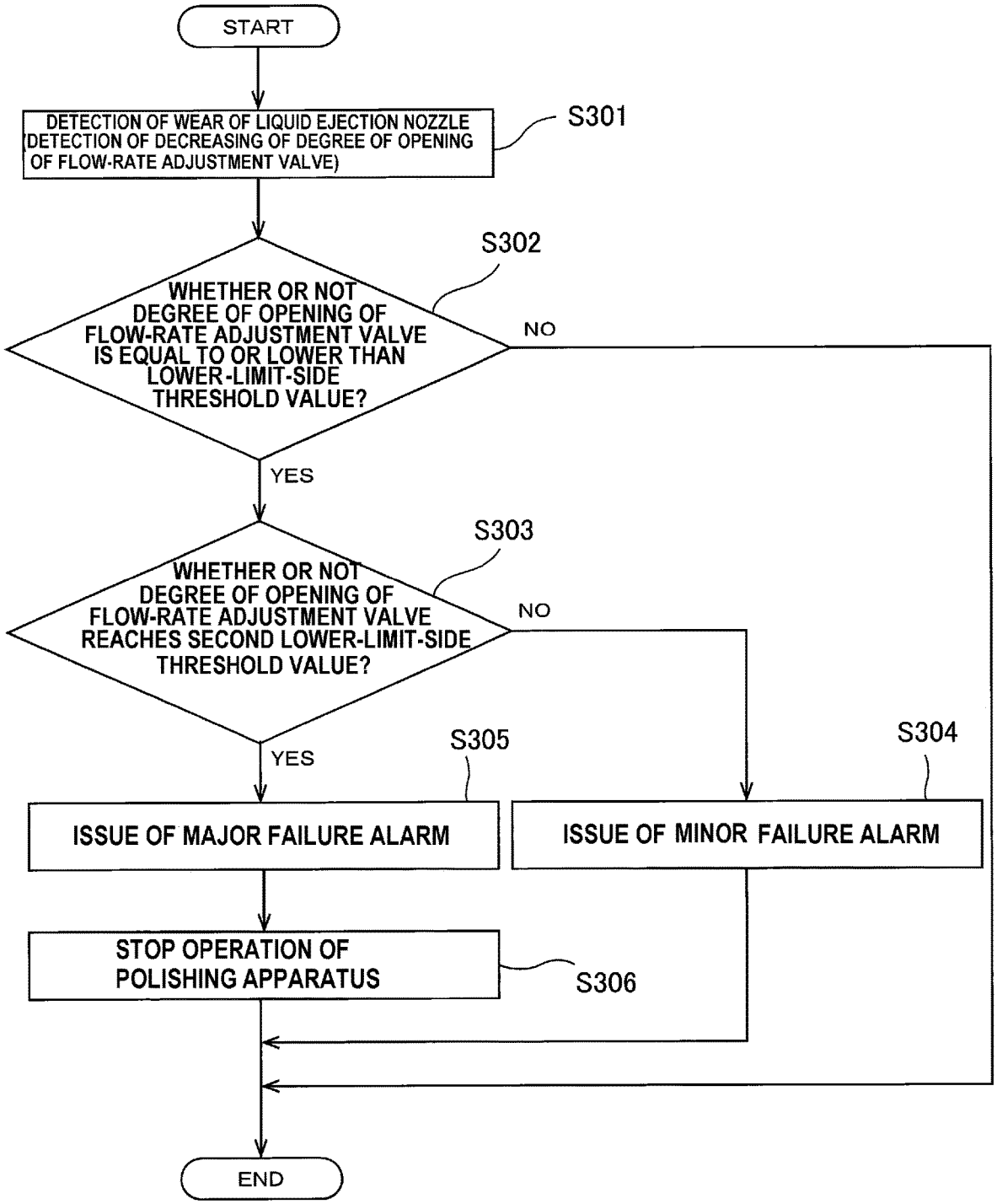
FIG. 16 is a view showing a flowchart for detecting the abnormality of the liquid ejection nozzle.

FIG. 16 is a view showing a flowchart for detecting an abnormality of the liquid ejection nozzle 33. When the nozzle abnormality detection device 70 detects the wear of the liquid ejection nozzle 33 (see step S301), it is determined whether or not the degree of opening of the flow-rate adjustment valve 73 is equal to or lower than the lower-limit-side threshold value (see step S302). When the determiner 72 determines that the degree of opening of the flow-rate adjustment valve 73 is larger than the lower-limit-side threshold value (see "NO" in step S302), the determiner 72 determines that the wear of the liquid ejection nozzle 33 is not abnormal to terminate the abnormality detection program for the liquid ejection nozzle 33.

When the determiner 72 determines that the degree of opening of the flow-rate adjustment valve 73 is equal to or lower than the lower-limit-side threshold value (see "YES" in step S302), the determiner 72 judges that the wear of the liquid ejection nozzle 33 is abnormal to determines whether or not the degree of opening of the flow-rate adjustment valve 73 reaches the second lower-limit-side threshold value (see step S303).

When the determiner 72 determines that the degree of opening of the flow-rate adjustment valve 73 does not reach the second lower-limit-side threshold value (see "NO" in step S303), the determiner 72 determines that the minor failure in the liquid ejection nozzle 33 occurs. In other words, the determiner 72 determines that the degree of opening the flow-rate adjustment valve 73 is equal to or lower than the first lower-limit-side threshold value and larger than the second lower-limit-side threshold value. In this case, the determiner 72 issues the minor failure alarm (see step S304).

When the determiner 72 determines that the degree of opening of the flow-rate adjustment valve 73 reaches the second lower-limit-side threshold value (see "YES" in step S303), the determiner 72 determines that the major failure in the liquid ejection nozzle 33 occurs to issue the major failure alarm (see step S305). Thereafter, the determiner 72 stops the operation of the polishing apparatus PA (step S306) to terminate the abnormality detection program of the liquid ejection nozzle 33.

If the abnormality in the liquid ejection nozzle 33 occurs, an angle of ejection of the liquid ejection nozzle 33 may change, or an appropriate amount of slurry may not be supplied. As described above, the spout range and the supply amount of polishing liquid greatly affect the removal rate of the substrate W. In this embodiment, the nozzle abnormality detection device 70 can determine the abnormality of the liquid ejection nozzle 33. Therefore, the polishing apparatus PA can improve its added value.

In one embodiment, the nozzle abnormality detection device 70 may determine not only the abnormality of the liquid ejection nozzle 33 but also the abnormality of at least one of the first slurry nozzle 31 and the second slurry nozzle 32.

Figure 17:
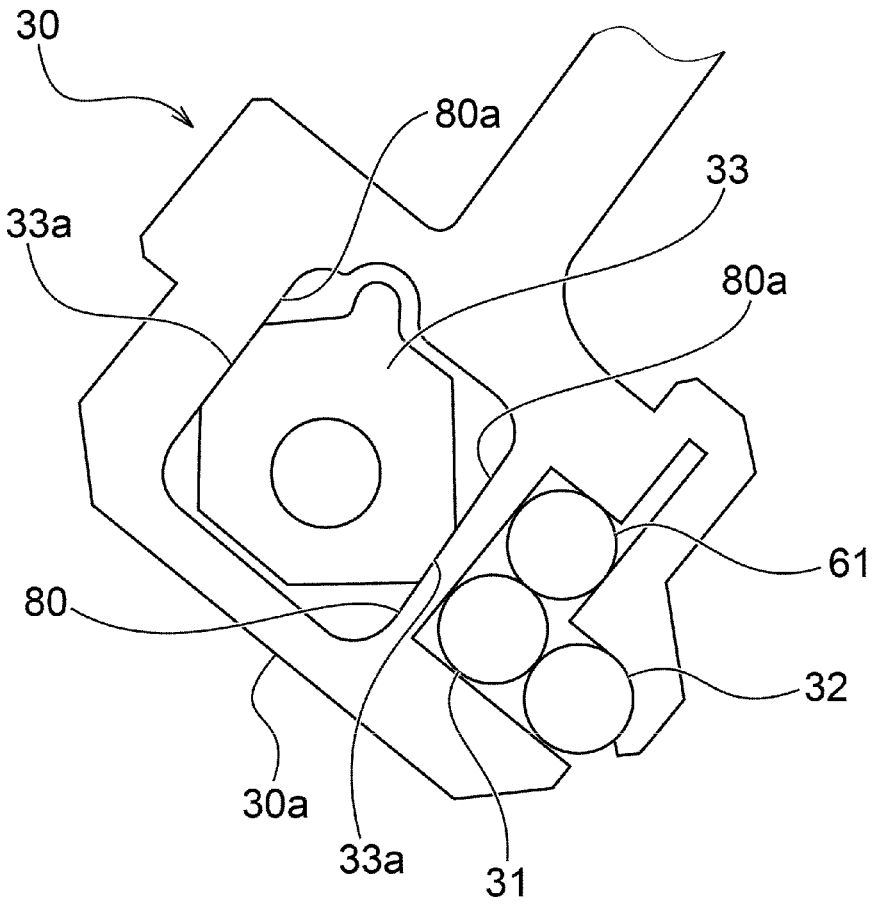
FIG. 17 is a view showing another embodiment of a liquid supply mechanism.

FIG. 17 is a view showing another embodiment of the liquid supply mechanism 4. With reference to the constructions of this embodiment which are the same as those of the above-described embodiment, a duplicate description thereof will be omitted.

In FIG. 17, the first slurry nozzle 31, the second slurry nozzle 32, the dressing liquid supply nozzle 61, and the liquid ejection nozzle 33 are illustrated when the tip portion 30*a* of the nozzle arm 30 is viewed from below. As shown in FIG. 17, the liquid ejection nozzle 33 may be disposed at the tip portion 30*a* of the nozzle arm 30.

In the embodiment shown in FIG. 17, not only the first slurry nozzle 31 and the second slurry nozzle 32 but also the liquid ejection nozzle 33 and the dressing liquid supply nozzle 61 are disposed at the tip portion 30*a* of the nozzle arm 30. The liquid ejection nozzle 33 has the same structure as that shown in FIG. 5. More specifically, the liquid ejection nozzle 33 is a fan-shaped nozzle having the liquid throttle surface 34*c*. The liquid throttle surface 34*c* is formed on the inner surface 34 of the liquid ejection nozzle 33, and has a tapered shape.

The tip portion 30*a* of the nozzle arm 30 has a positioning portion 80 for positioning the liquid ejection nozzle 33. The positioning portion 80 has a fitting surface 80*a* into which both surfaces 33*a* of the liquid ejection nozzle 33 are fitted. Therefore, the liquid ejection nozzle 33 is positioned by fitting the both surfaces 33*a* of the liquid ejection nozzle 33 into the fitting surface 80*a* of the positioning portion 80. In the embodiment shown in FIG. 17, the angle of inclination of the liquid ejection nozzle 33 can be changed by inclining the liquid ejection nozzle 33 with respect to a vertical direction.

Figure 18:
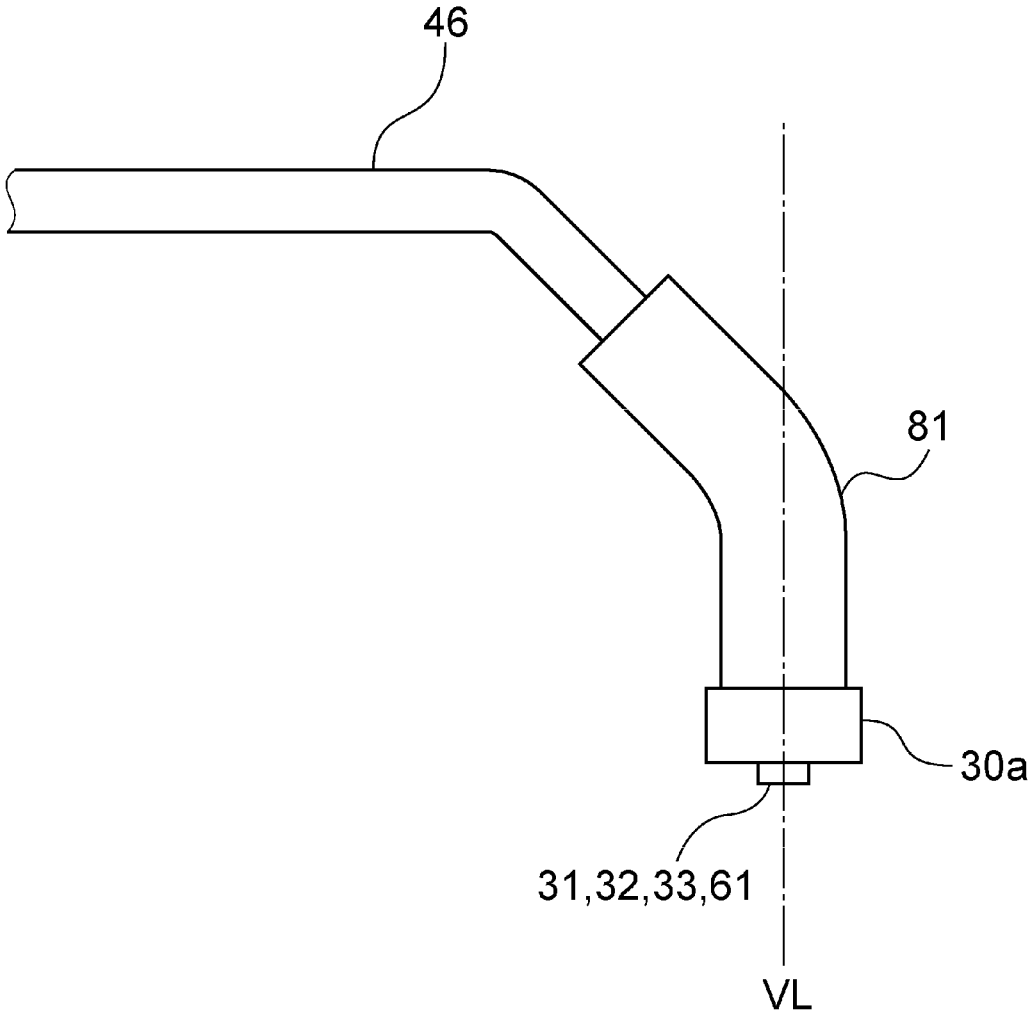
FIG. 18 is a view showing the third slurry line in the embodiment shown in FIG. 17.

FIG. 18 is a view showing the third slurry line 46 in the embodiment shown in FIG. 17. In FIG. 18, an illustration of the first slurry line 40 to which the first slurry nozzle 31 is connected, an illustration of the second slurry line 41 to which the second slurry nozzle 32 is connected, and an illustration of the dressing liquid supply line 62 to which the dressing liquid supply nozzle 61 is connected are omitted.

As shown in FIG. 18, the third slurry line 46 and the liquid ejection nozzle 33 are coupled by a joint 81. The joint 81 has a structure for preventing the retaining of the slurry. In this embodiment, the joint 81 is inclined with respect to a vertical direction VL for preventing the slurry from retaining (fixing). In one embodiment, the joint 81 is inclined at an angle of 45 degrees with respect to the vertical direction VL.

With such a structure, the slurry that passes through the joint 81 and is ejected from the liquid ejection nozzle 33 flows smoothly on the inner surface of the joint without retaining in the joint 81.

Also in the embodiments shown in FIGS. 17 and 18, the liquid ejection nozzle 33 is a fan-shaped nozzle. Therefore, the liquid ejection nozzle 33 can eject the slurry over a wide range. As a result, the polishing apparatus PA can reduce the amount of slurry to be used, and can improve the removal rate of the substrate W with respect to the amount of slurry to be used.

In one embodiment, the joint 81 may be connected to at least one of the first slurry line 40 and the second slurry line 41. In one embodiment, the abnormality detection program of the liquid ejection nozzle 33 by the nozzle abnormality detection device 70 is applicable not only to the embodiments shown in FIGS. 1 to 9 but also to the embodiments shown in FIGS. 17 and 18. In other words, the nozzle abnormality detection device 70 may be combined with all the components described in the above-described embodiments.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus, comprising:
a polishing table configured to support a polishing pad;
a top ring configured to press a substrate against the polishing pad; and
a liquid supply mechanism configured to supply a liquid onto the polishing pad,
wherein the liquid supply mechanism comprises:
a nozzle arm configured to be movable in a radial direction of the polishing table;
a slurry nozzle attached to the nozzle arm;
a liquid ejection nozzle attached to the nozzle arm, the liquid ejection nozzle configured to form a fan-shaped liquid spray pattern, the liquid ejection nozzle having a liquid passage surface, a liquid ejection surface, and a liquid throttle surface, the liquid throttle surface being formed on an inner surface of the liquid ejection nozzle and having a tapered shape;
a slurry line coupled to the liquid ejection nozzle and configured to supply a polishing liquid;
a coupling member connected to the slurry line; and
a flushing line coupled to the liquid ejection nozzle by way of a connection to the coupling member, the flushing line configured to supply a flushing liquid for cleaning the liquid ejection nozzle, wherein the flushing liquid flows through the flushing line to the slurry line by way of the coupling member.

2. The polishing apparatus according to claim 1, wherein:
the slurry nozzle is disposed above a center of the polishing pad when the nozzle arm is in a processing position; and
the liquid ejection nozzle is disposed at a region between the center of the polishing pad and an outer peripheral portion of the polishing pad when the nozzle arm is in the processing position.

3. The polishing apparatus according to claim 2, wherein the liquid supply mechanism comprises a nozzle cleaning device disposed outside the polishing pad, and
wherein the nozzle cleaning device comprises:
a first cleaning nozzle configured to clean the slurry nozzle; and
a second cleaning nozzle configured to clean the liquid ejection nozzle.

4. The polishing apparatus according to claim 1, further comprising an atomizer configured to eject a cleaning fluid onto the polishing pad,
wherein the liquid supply mechanism comprises a dressing liquid supply device attached to the atomizer;
wherein the dressing liquid supply device comprises:
a dressing liquid supply nozzle; and
a dressing liquid supply line to which the dressing liquid supply nozzle is connected and through which a dressing liquid flows.

5. The polishing apparatus according to claim 1, wherein:
the slurry nozzle and the liquid ejection nozzle are disposed above a center of the polishing pad when the nozzle arm is in a processing position.

6. The polishing apparatus according to claim 1, wherein the coupling member is disposed adjacent to the liquid ejection nozzle.

7. A polishing apparatus, comprising:
a polishing table configured to support a polishing pad;
a top ring configured to press a substrate against the polishing pad; and
a liquid supply mechanism configured to supply a liquid onto the polishing pad, the liquid supply mechanism comprising a nozzle arm configured to be movable in a radial direction of the polishing table, and a slurry nozzle attached to the nozzle arm,
wherein the liquid supply mechanism comprises a nozzle abnormality detection device configured to detect an abnormality of a liquid ejection nozzle
wherein the nozzle abnormality detection device comprises:
a flow-rate controller configured to control a flow-rate adjustment valve that controls a flow rate of the liquid flowing through a liquid supply line coupled to the liquid ejection nozzle; and a determiner configured to determine an abnormality of the liquid ejection nozzle based on a signal sent from the flow-rate controller, wherein the flow-rate controller is configured to control a degree of opening of the flow-rate adjustment valve, the flow-rate adjustment valve being configured to adjust a size of a flow path of the liquid supply line so that the flow rate of the liquid flowing through the liquid supply line becomes a preset flow rate, and wherein the determiner is configured to determine the abnormality of the liquid ejection nozzle based on the degree of opening of the flow-rate adjustment valve.

8. The polishing apparatus according to claim 7, wherein the determiner is configured to:

determine an abnormal clogging of the liquid ejection nozzle under a condition that the degree of opening of the flow-rate adjustment valve reaches a predetermined upper-limit-side threshold value; and determine an abnormal wear of the liquid ejection nozzle under a condition that the degree of opening of the flow-rate adjustment valve reaches a predetermined lower-limit-side threshold value.

9. The polishing apparatus according to claim 8, wherein:

the upper-limit-side threshold value has a first upper-limit-side threshold value and a second upper-limit-side threshold value larger than the first upper-limit-side threshold value; and the determiner is configured to issue one of a minor failure alarm for recommending an exchange of the liquid ejection nozzle and a major failure alarm for stopping an operation of the polishing apparatus based on the first upper-limit-side threshold value and the second upper-limit-side threshold value.

10. The polishing apparatus according to claim 8, wherein:

the lower-limit-side threshold value has a first lower-limit-side threshold value and a second lower-limit-side threshold value lower than the first lower-limit-side threshold value; and the determiner is configured to issue one of a minor failure alarm for recommending an exchange of the liquid ejection nozzle and a major failure alarm for stopping an operation of the polishing apparatus based on the first lower-limit-side threshold value and the second lower-limit-side threshold value.

* * * * *